United States Patent [19]

Bartholmey

[11] 4,075,868

[45] Feb. 28, 1978

[54] ICE MAKING MACHINE WITH IMPROVED DRIP SHIELD

[75] Inventor: Don S. Bartholmey, Bellevue, Wash.

[73] Assignee: North Star Ice Equipment Company, Seattle, Wash.

[21] Appl. No.: 703,518

[22] Filed: Jul. 8, 1976

[51] Int. Cl.[2] ..... F25C 1/14

[52] U.S. Cl. ..... 62/347; 62/354

[58] Field of Search ..... 62/347, 348, 354, 74

[56] References Cited

U.S. PATENT DOCUMENTS

| | | | |
|---|---|---|---|
| 2,683,357 | 7/1954 | Albright | 62/348 X |
| 2,712,734 | 7/1955 | Lees | 62/348 X |
| 2,716,869 | 9/1955 | Lees | 62/348 |
| 2,735,275 | 2/1956 | Branchflower | 62/347 X |
| 2,836,967 | 6/1958 | Kocher | 62/354 |
| 2,910,841 | 11/1959 | Branchflower | 62/347 |
| 3,403,532 | 10/1968 | Knowles | 62/354 X |

*Primary Examiner*—William E. Wayner
*Assistant Examiner*—William E. Tapolcai, Jr.
*Attorney, Agent, or Firm*—Graybeal, Barnard & Uhlir

[57] ABSTRACT

An ice making machine having an improved drip shield which prevents water from dripping into an ice storage bin beneath the machine. The ice machine has an inner freezing surface over which is spread water. Ice formed on the freezing surface is scraped therefrom by a rotating sweep arm having a plurality of sweeps thereon. The drip shield is frusto-conical in shape and is located at the bottom of the ice making machine and extends radially outward beyond the inner freezing surface of the machine. A portion of the drip shield adjacent the sweep arm is removed to allow ice to fall from the freezing surface into an ice storage bin. The drip shield is continuously washed by water from a spray tube located on the top portion of the drip shield and having a series of orifices therein thus preventing ice build-up on the drip shield and clogging of the machine. In the preferred embodiment the spray tube receives water recirculated through the ice machine from a water distribution ring located above the inner freezing surface of the ice machine.

11 Claims, 3 Drawing Figures

FIG. 1
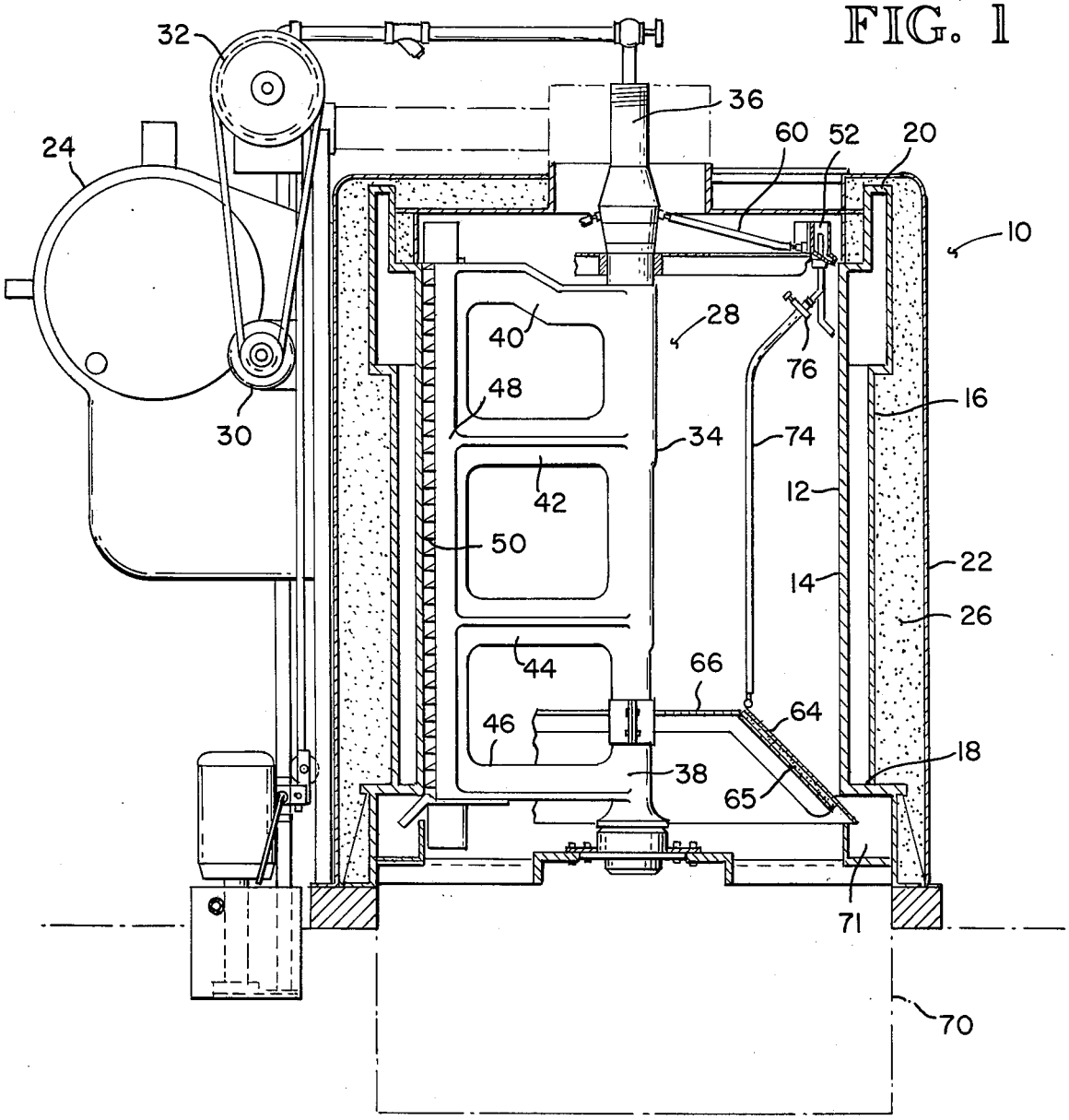
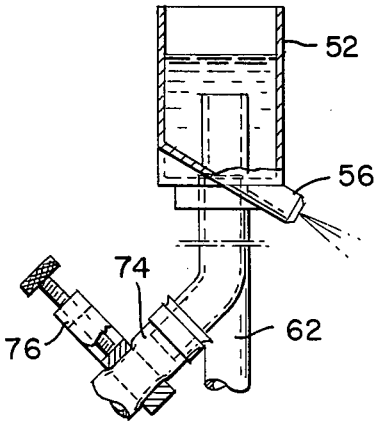
FIG. 3

ICE MAKING MACHINE WITH IMPROVED DRIP SHIELD

BACKGROUND OF THE INVENTION

1. Field of the Invention

This invention relates in general to a flake ice making machine and more particularly to a drip shield for a flake ice machine with a continuous water curtain flowing thereover which prevents water from dripping into the flake ice bin and unwanted ice from clogging the machine.

2. Description of the Prior Art

In a conventional flake ice making machine, water is allowed to contact a polished freezing surface and form ice thereon. The freezing surface is usually the inside surface of an upright vertical cylindrical shell which is surrounded by a quantity of circulating refrigerant, thus causing ice to form on the inner freezing surface. Examples of such ice making machines are shown in U.S. Pat. No. 2,683,357 issued on July 13, 1954 to E. J. Albright; U.S. Pat. Nos. 2,716,869 and 2,712,734 issued on Sept. 5, 1955 and July 12, 1955 respectively, to G. M. Lees; and U.S. Pat. Nos. 2,735,275 and 2,910,841 issued on Feb. 21, 1956 and Nov. 3, 1959 respectively, to L. E. Branchflower.

In these flake ice making machines, the ice which forms on the inner freezing surface of the vertical cylinder is removed from that surface by a plurality of sweeps or knives mounted on a support arm which rotates within the vertical cylinder. An ice bin or a collector is located beneath the cylinder and catches the falling ice which is removed from the freezing surface. A problem encountered in the operation of a flake ice making machine is that water may drip into the ice bin causing the ice in the bin to form lumps or mass together. The effectiveness of the ice machine depends in part upon its reliability in delivering a uniform product. Dry, cold, and crisp flaked ice is desired for maximum utility of the ice in freezing meats, fish, and other foods and substances.

In prior machines, unwanted dripping of water into the ice bin may occur in several ways, for example, when a nozzle which directs water onto the freezing surface of the vertical cylinder clogs, dripping of water directly into the ice bin may occur. Also, a water receiving pan is usually provided to receive water dripping from the freezing surface. This pan is placed slightly outside of the diameter of the freezing surface, and a bevel is provided on the bottom side of the freezing surface to lead dripping water outwardly into the water receiving pan. A disruption in the flow of water on the freezing surface, however, such as an irregular piece of frozen ice, may cause the dripping water to fall directly into the ice bin.

In U.S. Pat. No. 2,716,869 cited previously, a shield is provided to prevent water dripping directly from the inner freezing surface of the vertical cylinder from entering the ice bin. In equipment of this type, however, ice may form on the drip shield itself causing water to flood into the ice storage bin. Ice makers conventionally are located over ice storage bins which may reach temperatures as low as $-10°$ F. Very cold air from the ice bin circulates up into the machine and may cause the temperature of a drip shield to drop below the freezing temperature of water such that when a drop of water falls thereon, it freezes immediately. Formation of ice on the drip shield itself may result in blocking of the opening between the drip shield and the bottom of the freezing surface of the cylinder, causing water to back up on the drip shield and eventually overflow into the ice bin.

SUMMARY OF THE INVENTION

The present invention provides apparatus for an ice making machine which prevents water from contaminating the ice previously formed by the machine. The ice making apparatus of the present invention includes a drum or vertical cylinder which has an inner freezing surface. The inner freezing surface is maintained at a temperature below the freezing temperature of water by a suitable refrigerant surrounding the drum. A rotor assembly is disposed within the stationary drum and can be rotated by a suitable drive unit and motor. A water distributor is mounted on the rotor assembly and is connected to a source of water such that water is distributed to the inner freezing surface of the drum as the rotor assembly rotates. Preferably, the water distributor includes equally spaced nozzles which distribute the water onto the top portion of the inner freezing surface. An ice remover or sweeps are provided which function as knives or scrapers, removing the ice from the freezing surface. The ice sweeps are mounted on and rotate with the rotor assembly.

To catch water runoff from the freezing surface, a drip shield or deflector is provided at the bottom of the drum. The outer edge of the drip shield extends radially outward of the inner freezing surface of the drum. The drip shield has an arcuate portion removed therefrom so that ice swept from the drum by the ice remover may fall directly into an ice bin located beneath the ice machine. A water receiving pan surrounds the base of the drum and receives water running off of the drip shield. Ice is prevented from forming on the drip shield by water from a water spray tube which continually washes the surface of the drip shield. The water spray tube receives water via tubing from the water distributor.

In a preferred embodiment of the invention, the water receiving pan is connected to a water reservoir which in turn connects to the water distributor. Incoming water from a water source at an initial preferred temperature of about 45° F. is first circulated around the water receiving pan where it mixes with runoff from the drip shield and then back to the water reservoir. The circulated water is then pumped to the top of the ice machine and into the water distributor where it either flows onto the inner freezing surface or through tubing to the spray tube which washes the drip shield.

It is an object of the present invention to provide a flake ice making apparatus which prevents ice from clogging the machine and water from contaminating the flake ice.

Another object of the present invention is to provide a relatively simple, reliable, and inexpensive apparatus in a flake ice making machine for assuring that dripping water does not contaminate the flake ice produced.

A further object of the present invention is to provide a drip shield for an ice making machine which will not form ice on its surface, thus preventing water from backing up into the flake ice storage bin.

One more object is to provide a water circulation system and drip shield for an ice making machine whereby, in operation, a water system flows continuously over substantially the entire surface of the drip shield.

The novel features which are believed to be characteristic of the present invention, both as to its structure and method of operation, together with further objects and advantages thereof, will be better understood from the following description considered in connection with the accompanying drawings in which one embodiment of the invention is illustrated by way of example. It is to be expressly understood, however, that the drawing is for the purpose of illustration and description only and is not intended as a definition of the limits of the invention.

BRIEF DESCRIPTION OF THE DRAWINGS

FIG. 1 is a sectional elevation view on the diameter of an ice making apparatus embodying the present invention;

FIG. 3 is a detailed sectional elevation view of a water distributor ring and nozzle.

DESCRIPTION OF THE PREFERRED EMBODIMENT

Figure 2:
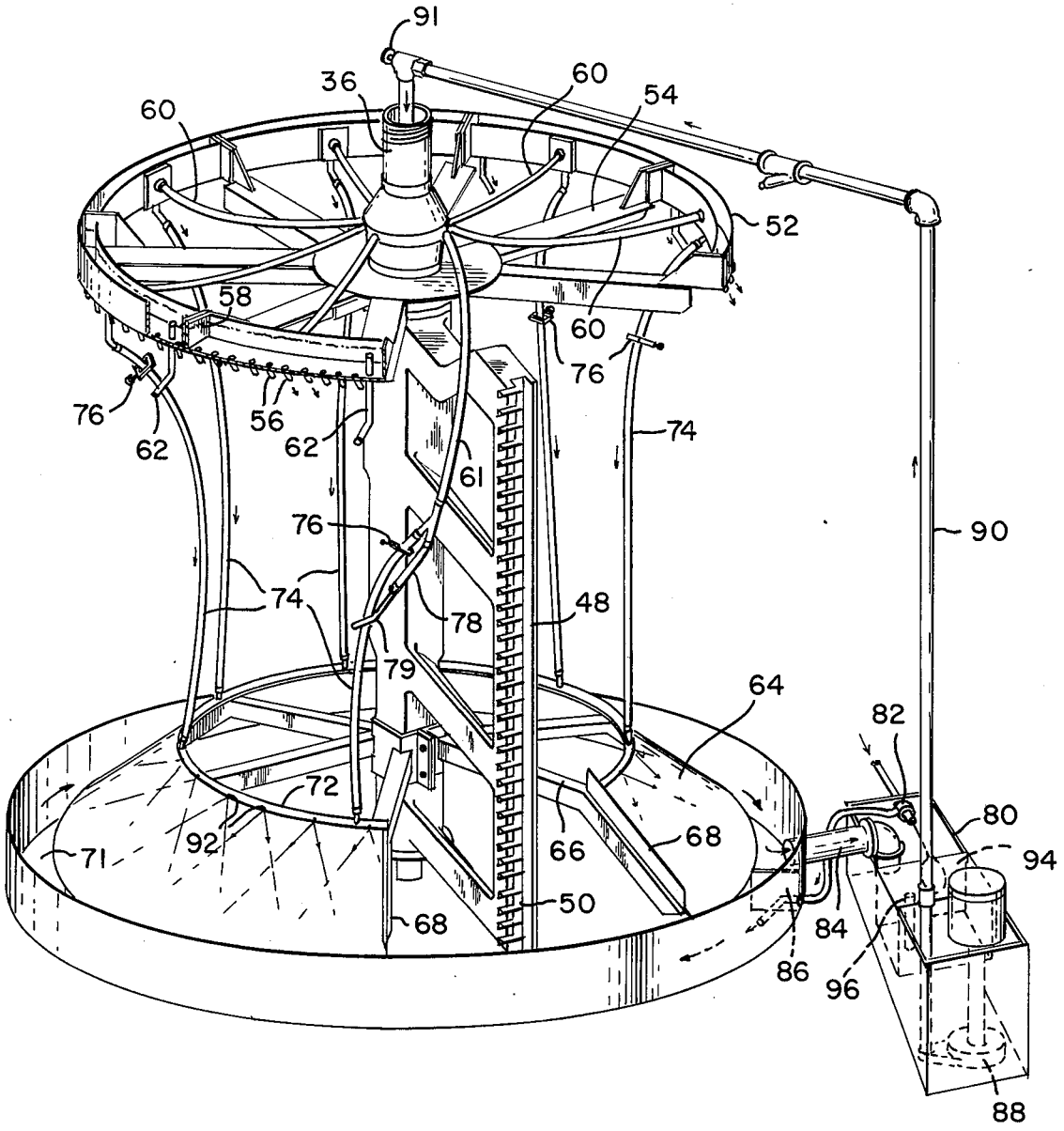
FIG. 2 is a perspective view of the water distribution system of an ice making apparatus embodying the present invention.

Referring now to FIG. 1, an ice making apparatus, generally designated 10, is disclosed including a vertical drum of substantially cylindrical shape. The vertical drum comprises an inner shell 12 with an inner freezing surface 14 on which is formed a thin sheet of ice to be removed therefrom in the form of small flakes, a middle shell 16 concentric of the inner shell and spaced outwardly therefrom, a bottom end closure annulus 18, a top closure annulus 20, and an outer plastic cover or shell 22 concentric to the inner and middle shells and spaced outwardly therefrom. Standard refrigerants such as Freon or ammonia or ethylene glycol or salt brine may be used in the apparatus and occupy the space enclosed by the inner shell 12, middle shell 16, and top and bottom end closures 20 and 18 respectively. Evaporator 10 is usable with either a flooded or pumped refrigerant system. Refrigerant is delivered to the interior of evaporator 10 by way of accumulator 24 through suitable connecting means (not shown). Occupying the space between the middle shell 16 and the outer cover 22 is a layer of insulation 26. In actual use of the equipment, insulation (not shown) also surrounds the accumulator 24.

A rotor assembly, generally designated as 28, is the moving assembly in the ice making machine. This rotor assembly 28 is driven by a motor 30 mounted adjacent to the evaportator 10. The motor 30 is connected to a suitable drive unit 32 translating the output of motor 30 into rotation of rotor assembly 28. Rotor assembly 28 has a central shaft 34 with a top section 36 and a bottom section 38. Secured to shaft 34 are shaft arms 40, 42, 44, and 46. These arms carry a sweep rail 48 which extends substantially from the top edge to the lower edge of freezing surface 14, and that is placed in proximity thereto with its side opposed to such surface.

A series of sweeps, individually designated as 50, are secured to the side of sweep rail 48. Each sweep 50 is somewhat in the form of a flat plate having one edge secured to the sweep rail 48. Each sweep 50 extends away from the rail 48 and rearwardly of the trailing edge of the rail and includes a sharp edge in opposed relation to the freezing surface 14 which removes the ice therefrom during operation of the apparatus. The sharp edges are obtained by beveling the top of the rear portion of each sweep. In one form, the edges of each sweep 50 are disposed at a slight angle, approximately 4°–5°, to a plane normal to the axis of the freezing surface 14. The edges are machined to a curve similar to that of the curve of the inner freezing surface 14. In a preferred form, the sweeps are equally spaced on sweep rail 48 about one and one-half inches apart, and may be secured thereto by welding, bolting, or keying.

Referring additionally to FIG. 2, a water distributing ring 52 is shown mounted on the top section 36 of the rotor assembly 28. Ring 52 is concentric of the apparatus 10, adjacent the freezing surface 14, and carried on ring arms 54 secured to the top section of shaft 34. The water distributing ring is hollow, generally rectangular in cross section, and includes around its lower outer edge a series of nozzles or orifices shaped to direct streams of water in the direction of rotation of the water ring and onto the top portion of inner freezing surface 14. The directing of the water against and circumferentially of the inner freezing surface 14 in the manner disclosed allows the water to spread downwardly over the entire freezing surface without channeling. As disclosed, the water ring 52 is divided into arcuately equal sections, each section being separated by a divider 58. An open portion is provided in the ring adjacent sweep rail 48 to allow the ice time to dry and be removed by the sweeps.

The volume of water delivered through the ring 52 is maintained constant by holding a substantially fixed pressure or head in the ring above nozzles 56. Water is introduced into the top section 36 of shaft 34 and is then distributed to each section of ring 52 through tubes 60. Overflow tubes 62 are provided in each section of ring 52 with their top openings a fixed distance above nozzles 56 (FIG. 3). All sections of the water ring 52, except the first section behind sweep arm 48, also include bottom openings to downwardly extending conduits which will be described hereafter. The downwardly extending conduits include valve means whereby the flow of water out of the bottom of the ring sections may be controlled such that the level of water in the ring sections above nozzles 56 may be held relatively constant. Overflow water from ring 52 passes through overflow tubes 62 to the top of the inner freezing surface 14 as best seen in FIGS. 2 and 3.

The bottom section 38 of shaft 34 has a drip shield 64 mounted thereon. Drip shield 64 is carried on ring arms 66, and serves as a deflector for drops of water dripping from the inner freezing surface 14. An insulating material 65 is mounted on the bottom side of shield 64 to partially counter the tendency of the very cold air moving up from the ice storage bin 70 to lower the temperature of shield 64 such that ice forms thereon. Drip shield 64 extends circumferentially beyond the inner freezing surface 14, and has a portion removed therefrom adjacent sweep arm 48 to allow ice removed from the inner freezing surface 14 by sweeps 50 to fall therethrough. Guards 68 are placed at each end of the opening or "window" in the drip shield 64 to prevent water from flowing off the side of the drip shield into the ice bin 70 (FIG. 1) located therebeneath. The arcuate opening in drip shield 64 is substantially equal in arc to the opening in water ring 52 discussed heretofore. A fixed, circular, water receiving pan 71 surrounds the bottom of the drip shield 64, and receives water from shield 64.

An annular spray tube 72 mounted on the top of drip shield 64 has a plurality of small orifices therein allowing water to spray onto the drip shield continuously during operation of the ice machine. The spray tube 72 is fed by a series of downwardly extending tubes 74, discussed heretofore, connected to the water distributing ring 52 and the flow of spray water is controlled by valving means such as pinch clamps 76 positioned thereon. The level of water in each section of ring 52 is also controlled by clamps 76, and is appropriately maintained about one quarter inch above overflow tubes 62 to ensure a full flow of water to the freezing surface of the apparatus.

The tube 61 which corresponds with the open portion of ring 52 extends out of top section 36 and leads directly to a downwardly extending tube 74 having a pinch clamp 76 positioned thereon. A section of tubing 78 and a spray nozzle 79 are additionally provided at this intersection to distribute water to the central portion of the freezing surface behind the sweep rail 48 as it rotates. In this way, the entire freezing surface 14 immediately behind the sweep rail is rapidly covered with water after sweeps 50 have removed the ice therefrom thus hastening the formation of a new ice coating thereon.

Water is distributed to the water distributing ring 52 and throughout the entire system in the following manner. A water reservoir 80 or makeup tank is located outside of the evaporator and receives incoming water from a water source (not shown), at a preferred temperature of about 45° F. if available. A float control valve 82 in reservoir 80 controls the intake of makeup water. Incoming water flows first into water receiving pan 71 located at the bottom of the inner freezing surface 14, and then flows clockwise 360° around the water receiving pan and drains out into the water reservoir 80 via drain pipe 84. At this point the water temperature, due in part to its being mixed with runoff water from freezing surface 14 has been lowered to about 32° F. A dam 86 prevents water from short circuiting in the receiving pan 71. Water is then pumped by pump 88 from reservoir 80 to the top section 36 of the rotor assembly 28 through line 90.

The incoming water level in the hollow top section 36 of the rotor assembly 28 is maintained by control valve 91 at a level above tubes 60 which ensures a full flow condition to ring 52. Tubes 60 feed water to the respective sections of the water ring 52, while tube 61 feeds water directly to the spray tube 72 and to the central portion of the freezing surface as described heretofore. The water level in the ring 52 is maintained above the level of overflow tube 62 and water is directed through orifices 56 to the top of the inner freezing surface 14. Tubes 74 lead to the spray tube 72 which maintains a constant water wash over the drip screen through a plurality of small orifices 92. The orifices 92 are spaced such that the water washing the surface of drip shield 64 covers such surface. The drip shield 64 extends radially outward over the edge of the water receiving pan 71, so all water is deflected into this pan. The drip shield 64 ensures that all excess water flowing off of the inner freezing surface 14, as well as any drippage or overflow from the water distributing ring 52 is directed back into the receiving pan 71. Thus, the drip shield ensures that no water falls into the ice storage bin 70. All water from the drip shield flows back into the water receiving pan 71 to join with and cool the new incoming makeup water and then returns to reservoir 80 for recirculation.

The continuous water wash provided by spray tube 72 prevents the formation of ice either on the drip shield 64 or in the water receiving pan 71 thereby preventing ice from clogging the machine and causing water to overflow into the ice receiving bin.

A "T" connection may be added in the water pump line 90 to feed a small amount of water over to a salt feeder tank 94 located within reservoir 80. To add salt brine to the makeup water, the salt tank 94 may be filled with coarse rock salt. Water fed to the salt tank 94 will overflow a stand pipe 96 in the salt tank and drip salt brine into the makeup water. The salinity of the brine is controlled by positioning the water inlet to the salt tank closer to the stand pipe 96 for less salinity and farther from the stand pipe 96 for greater salinity.

In operation of the present invention, movement of rotor assembly 28 is initiated by the operation of motor 30. Incoming water is pumped to the water distributing ring 52 and allowed to cover inner freezing surface 14 via nozzles 56 and overflow tubes 62. The inner freezing surface is maintained at a temperature below 32° F. so that ice forms rapidly thereon. The arcuate opening in the water distributing ring 52 provides a period during which water is not applied to a portion of the freezing surface, thus allowing the ice to dry, harden and subcool. This dry ice is removed from the freezing surface by sweeps 50 and cascades downwardly to fall into bin 70.

The present invention provides the dual advantages of preventing ice formation on the drip shield and consequent clogging and flooding of the machine, while allowing cooling of the incoming water to a near freezing temperature before it is introduced onto the freezing surface of the apparatus. This results in more efficient operation of the equipment. Further, it has been found that when the incoming water is cooled to approximately 32° F. before contacting the freezing surface, water drippage or runoff from the freezing surface is reduced than when higher temperature water is used.

The invention may be embodied in other forms without departing from the spirit or essential characteristics thereof. The present embodiments disclosed are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An ice making apparatus including:

a. a substantially vertical drum having an inner freezing surface;

b. rotor means at least partially disposed within said drum and capable of rotating within said drum;

c. water distributing means communicating with said rotor means for distributing water to at least a portion of the inner surface of said drum;

d. cooling means interconnected with said drum for maintaining the inner surface of said drum at a predetermined temperature below the freezing temperature of water whereby water distributed onto the inner surface of said drum is caused to form ice;

e. ice removal means mounted on said rotor means for removing ice from the inner surface of said drum when said rotor means rotates;

f. deflector means mounted on said rotor means for deflecting water dripping from the inner freezing surface of said drum, with the outer edge of said deflector means extending more radially outwardly than the inner freezing surface of said drum, said deflector means having a portion removed therefrom so that ice scraped from the inner surface of said drum by said ice removalmeans falls from said drum without striking said deflector means;

g. water receiving means surrounding said drum for receiving water deflected by said deflector means; and h. tube means communicating with said water distributing means for distributing a portion of the water from said water distributing means to a spray tube means, said spray tube means being annular in shape with a portion removed therefrom, and having a plurality of holes therein for distributing water onto substantially the entire surface of said deflector means.

2. The apparatus of claim 1 wherein said tube means includes, a. first tube means connected at its upper end to said water distributing means, and b. spray tube means connected to the lower ends of said first tube means, said spray tube means being annular in shape with a portion removed therefrom, and having a plurality of holes therein for distributing water onto substantially the entire surface of said deflector means.

3. The apparatus of claim 1 wherein said water distributing means includes means for directing water onto the mid portion of said inner freezing surface adjacent and behind said rotating ice removal means.

4. The apparatus of claim 1 further including valve means associated with said first tube means for controlling the flow of water through said first tube means.

5. The apparatus of claim 1 wherein the portions removed from said water distributing means and said spray tube means are substantially equal in arc.

6. An ice making apparatus including:

a. a fixed vertical cylindrical shell having an inner freezing surface;

b. rotor means mounted to extend axially within said cylindrical shell and capable of rotating therein;

c. water distributing means mounted on said rotor means for distributing water to the inner freezing surface of said shell;

d. cooling means communicating with said shell for maintaining the inner freezing surface thereof at a temperature whereby water distributed thereon is caused to form ice;

e. ice removal means mounted on said rotor means for continuously removing ice from a vertical section of said inner freezing surface as said rotor means rotates, whereby said ice falls downwardly out of said shell;

f. deflector means mounted on said rotor and rotating therewith for deflecting water dripping from the inner freezing surface of said shell, said deflector means being generally frusto-conical in shape but having a portion removed therefrom adjacent said ice removal means so that ice removed from said inner freezing surface of said shell may fall from said shell without striking said deflector means;

g. spray tube means mounted along the top edge of said deflector means, said spray tube means receiving water from said water distributing means and spraying water over substantially the entire surface of said deflector means to prevent ice buildup thereon; and h. a water receiving pan for receiving water from said deflector means.

7. The apparatus of claim 6 wherein said water distributing means includes an annular water ring having a portion removed therefrom adjacent said ice removal means, said water ring being mounted on said rotor means and having a plurality of bottom nozzles for distributing water onto the inner freezing surface of said shell.

8. The apparatus of claim 6 wherein said spray tube means receives water from said water distributing means through tubing including valve means for controlling the flow through said tubing.

9. The apparatus of claim 6 wherein said water receiving pan is circular and positioned generally beneath said inner freezing surface, and has an inner diameter slightly larger than the inner diameter of said cylindrical inner freezing surface.

10. The apparatus of claim 6 wherein said water distributing means includes tube means directing water onto the mid portion of said inner freezing surface behind said rotating ice removal means.

11. An ice making apparatus comprising:

a. a substantially vertical drum having an inner freezing surface;

b. rotor means at least partially disposed within said drum and capable of rotating within said drum;

c. water distributing means communicating with said rotor means for distributing water to at least a portion of the inner freezing surface of said drum;

d. cooling means mounted on said drum for maintaining the inner surface of said drum at a predetermined temperature whereby water distributed onto the inner freezing surface of said drum is caused to form ice;

e. ice removal means mounted to said rotor means for removing ice from the inner freezing surface of said drum when said rotor means rotates;

f. deflector means mounted on said rotor means for deflecting water dripping from the inner surface of said drum, with the outer edge of said deflector means extending more radially outward than the inner freezing surface of said drum, said deflector means having a portion removed therefrom so that ice scraped from the inner surface of said drum by said ice removal means can fall from said drum without striking said deflector means;

g. insulation means mounted on the bottom surface of said deflector means and covering a substantial portion of the surface area thereof;

h. water receiving means surrounding said drum for receiving water deflected by said deflector means;

i. a water reservoir communicating with said water receiving means for receiving water from said water receiving means;

j. recirculating means communicating with said water distributing means and said water reservoir for recirculating a portion of water from said reservoir to said water distributing means; and k. tube means communicating with said water distributing means for distributing a portion of the water from said water distributing means onto at least a portion of said deflector means thereby preventing ice from forming on said deflector means.

* * * * *